US011318433B2

(12) United States Patent
Kamiya et al.

(10) Patent No.: US 11,318,433 B2
(45) Date of Patent: May 3, 2022

(54) ATOMIZATION DEVICE

(71) Applicant: MEIJI CO., LTD., Tokyo (JP)

(72) Inventors: Tetsu Kamiya, Tokyo (JP); Yoshinori Satake, Tokyo (JP); Keigo Hanyu, Tokyo (JP); Masashi Onozato, Tokyo (JP)

(73) Assignee: MEIJI CO., LTD., Tokyo (JP)

( * ) Notice: Subject to any disclaimer, the term of this patent is extended or adjusted under 35 U.S.C. 154(b) by 141 days.

(21) Appl. No.: 16/650,652

(22) PCT Filed: Sep. 28, 2018

(86) PCT No.: PCT/JP2018/036301
§ 371 (c)(1),
(2) Date: Mar. 25, 2020

(87) PCT Pub. No.: WO2019/065988
PCT Pub. Date: Apr. 4, 2019

(65) Prior Publication Data

US 2020/0222865 A1 Jul. 16, 2020

(30) Foreign Application Priority Data

Sep. 29, 2017 (JP) ..... JP2017-190102

(51) Int. Cl.
*B01F 27/94* (2022.01)
*B01F 27/272* (2022.01)
(Continued)

(52) U.S. Cl.
CPC ..... *B01F 27/272* (2022.01); *B01F 23/43* (2022.01); *B01F 23/53* (2022.01); *B01F 27/941* (2022.01); *B01F 2101/14* (2022.01)

(58) Field of Classification Search
CPC ..... B01F 15/0251; B01F 2215/0022; B01F 3/0853; B01F 3/1221; B01F 7/0075;
(Continued)

(56) References Cited

U.S. PATENT DOCUMENTS 1,711,154 A * 4/1929 Michal ..... B02C 13/22 241/146
3,194,540 A * 7/1965 Hager ..... A01J 11/16 366/305
(Continued)

FOREIGN PATENT DOCUMENTS

JP 57-45331 3/1982
JP 63-49239 3/1988
(Continued)

OTHER PUBLICATIONS

International Search Report dated Jan. 8, 2019 in corresponding International Application No. PCT/JP2018/036301.

*Primary Examiner* — Marc C Howell
(74) *Attorney, Agent, or Firm* — Wenderoth, Lind & Ponack, L.L.P.

(57) ABSTRACT

An atomization device 1 comprises a casing 2, a rotor 3 disposed rotatably with respect to the casing 2, and a stator 4 disposed on the same axis line with the rotor 3. The rotor 3 includes a first rotor cylinder portion 33 and a second rotor cylinder portion 34 which have a plurality of through-holes provided in peripheral walls thereof and which are disposed concentrically. The stator 4 includes a main-stator cylinder portion 42 and an inside sub-stator cylinder portion 43 which have a plurality of through-holes provided in peripheral walls thereof and which are disposed concentrically. The rotor 3 is fixedly positioned with respect to the casing 2. The stator 4 is movable by a lifting/lowering means 7 in the axial line L direction.

6 Claims, 7 Drawing Sheets

(51) Int. Cl.
*B01F 23/43* (2022.01)
*B01F 23/53* (2022.01)
*B01F 101/14* (2022.01)

(58) Field of Classification Search
CPC .... B01F 7/008; B01F 7/285; B01F 35/71775; B01F 2101/14; B01F 23/43; B01F 23/53; B01F 27/27; B01F 27/272; B01F 27/941
See application file for complete search history.

(56) References Cited

U.S. PATENT DOCUMENTS 3,744,763 A * 7/1973 Schnoring ..... B01F 5/0451 366/178.1
3,998,433 A * 12/1976 Iwako ..... B01F 7/00758 366/178.3
4,201,487 A * 5/1980 Backhaus ..... A47J 43/04 366/159.1
4,283,016 A * 8/1981 Reinhall ..... D21D 1/30 241/21
4,361,414 A * 11/1982 Nemes ..... F04D 29/447 366/304
4,860,960 A * 8/1989 Schwarz ..... B01F 7/04 241/89.3
5,205,647 A * 4/1993 Ricciardi ..... B01F 5/0684 366/162.2
5,366,288 A * 11/1994 Dahllof ..... B01F 3/0861 366/176.2
5,398,876 A * 3/1995 Reinhall ..... B02C 7/14 241/259.2
5,538,343 A * 7/1996 Tynan ..... B01D 19/0052 366/305
5,590,961 A * 1/1997 Rasmussen ..... B01F 7/00758 366/165.1
5,622,650 A * 4/1997 Rourke ..... B01F 7/00775 241/152.2
6,019,499 A * 2/2000 Selivanov ..... B01J 19/008 366/171.1
6,024,308 A * 2/2000 Bartels ..... B02C 7/12 241/261.3
6,250,573 B1 * 6/2001 Kriebel ..... D21B 1/14 241/17
6,354,729 B1 * 3/2002 Brown ..... B01F 5/12 366/304
6,412,714 B1 * 7/2002 Witsken ..... B01F 7/0075 241/21
6,479,041 B2 * 11/2002 Huff ..... A61K 8/044 424/401
6,783,271 B1 * 8/2004 Makarenko ..... B01F 3/0807 366/171.1
6,857,774 B2 * 2/2005 Kozyuk ..... B01F 3/0807 366/263
6,883,737 B2 * 4/2005 Fisch ..... B01F 7/008 241/248
7,121,714 B2 * 10/2006 Parker Metcalfe, III ..... B01F 7/008 366/175.1
7,690,833 B2 * 4/2010 Metcalfe, III ..... F28D 11/02 366/146
7,806,584 B2 * 10/2010 Wootan ..... B01F 7/008 366/170.3
7,815,362 B2 * 10/2010 Myhrberg ..... B01F 3/0853 366/273
7,832,920 B2 * 11/2010 Wood ..... C09K 3/00 366/170.3
8,449,172 B2 * 5/2013 Wood ..... B01F 3/04531 366/170.3
9,034,195 B2 * 5/2015 Wood ..... E21B 43/121 210/750
9,174,218 B2 * 11/2015 Merle ..... B01F 7/00825
9,370,755 B2 * 6/2016 Kamiya ..... B01F 7/00833
9,539,551 B2 * 1/2017 Brown ..... B01F 7/00816
2003/0213860 A1 * 11/2003 Pilao ..... D21D 1/22 241/261.1
2004/0187770 A1 * 9/2004 Calabrese ..... B01D 9/0054 117/200
2010/0303917 A1 * 12/2010 Watson ..... C12N 13/00 424/489
2010/0303918 A1 * 12/2010 Watson ..... A61K 31/58 424/489
2011/0008462 A1 * 1/2011 Wood ..... B01F 7/00783 424/613
2011/0075507 A1 * 3/2011 Wootan ..... B01F 7/00825 366/124
2014/0192614 A1 7/2014 Kamiya
2015/0238913 A1 * 8/2015 Luharuka ..... B01F 7/00641 366/138
2016/0271575 A1 * 9/2016 Berger ..... B01F 7/00708
2019/0055615 A1 * 2/2019 Medoff ..... B01F 15/00246
2020/0222865 A1 * 7/2020 Kamiya ..... B01F 3/0853
2020/0289992 A1 * 9/2020 Scholten ..... B01F 7/0075

FOREIGN PATENT DOCUMENTS

JP 10-226981 8/1998
JP 2005-523147 8/2005
JP 2010-508139 3/2010
JP 2016-87590 5/2016
JP 2019-63713 A * 4/2019 ..... B01F 7/32
WO 93/10665 6/1993
WO 03/089123 10/2003
WO 2008/052143 5/2008
WO 2013/027650 2/2013

* cited by examiner

ATOMIZATION DEVICE

TECHNICAL FIELD

The present invention relates to an atomization device.

This application claims the benefit of priority based on Japanese Patent Application No. 2017-190102, filed on Sep. 29, 2017, the disclosure of which is incorporated herein by reference.

BACKGROUND ART

A conventional example of technology in the relevant field is described in Patent Literature 1 indicated below. Patent Literature 1 discloses an atomization device provided with a cylindrical stirring tank and a cylindrical rotary impeller which has a plurality of radially penetrating through-holes and which is disposed concentrically with the stirring tank. In the atomization device, an intermediate layer member having a plurality of through-holes is further provided between the stirring tank and the rotary impeller, in order to apply shear stress to the object to be atomized and to improve atomization efficiency.

CITATION LIST

Patent Literature

Patent Literature 1: JP 2016-87590 A

SUMMARY OF INVENTION

Technical Problem

However, in the above atomization device, the relative position between the rotary impeller and the intermediate layer member is fixed, resulting in the problem that it is impossible to adjust the shear stress applied to the object.

The present invention has been made to solve the technical problem, and an object of the present invention is to provide an atomization device capable of adjusting the shear stress applied to an object to be atomized.

Solution to Problem

An atomization device according to the present invention includes a casing, a rotor disposed rotatably with respect to the casing, and a stator disposed on the same axis line with the rotor. The rotor has a plurality of concentrically disposed rotor cylinder portions each having a plurality of through-holes provided in a peripheral wall thereof. The stator has at least one main-stator cylinder portion which has a plurality of through-holes provided in a peripheral wall thereof and which is inserted between rotor cylinder portions adjacent to each other. The rotor and the stator are relatively movable along the axial line direction.

In the atomization device according to the present invention, the rotor and the stator are relatively movable along the axial line direction. Accordingly, by changing the relative position between the rotor and the stator, it is possible to adjust the shear stress applied to an object to be atomized. Thus, atomization performance can be increased and versatility of the device can be enhanced.

Preferably, in the atomization device of the present invention, the stator may further include an inside sub-stator cylinder portion which is disposed inside a rotor cylinder portion positioned on an inner-most side radially among the plurality of rotor cylinder portions, and which has a plurality of through-holes provided in a peripheral wall thereof.

Preferably, in the atomization device of the present invention, the stator may further include an outside sub-stator cylinder portion which is disposed outside a rotor cylinder portion positioned on an outer-most side radially among the plurality of rotor cylinder portions, and which has a plurality of through-holes provided in a peripheral wall thereof.

Preferably, in the atomization device of the present invention, the rotor may be fixedly positioned with respect to the casing, and the stator may be movable by a lifting/lowering means along the axial line direction.

Preferably, in the atomization device of the present invention, the stator may be movable such that a lower end of the main-stator cylinder portion is positioned above an upper end of the rotor cylinder portions.

Preferably, in the atomization device of the present invention, the stator may further include a link portion formed integrally with the main-stator cylinder portion and linked with the lifting/lowering means.

Preferably, in the atomization device of the present invention, the casing may be a tank with an upper opening, and the atomization device may further include a rotary blade which is disposed between a bottom portion of the casing and the rotor and which rotates as the rotor rotates.

Advantageous Effects of Invention

According to the present invention, it is possible to adjust the shear stress applied to an object to be atomized.

DESCRIPTION OF EMBODIMENTS

Figure 1:
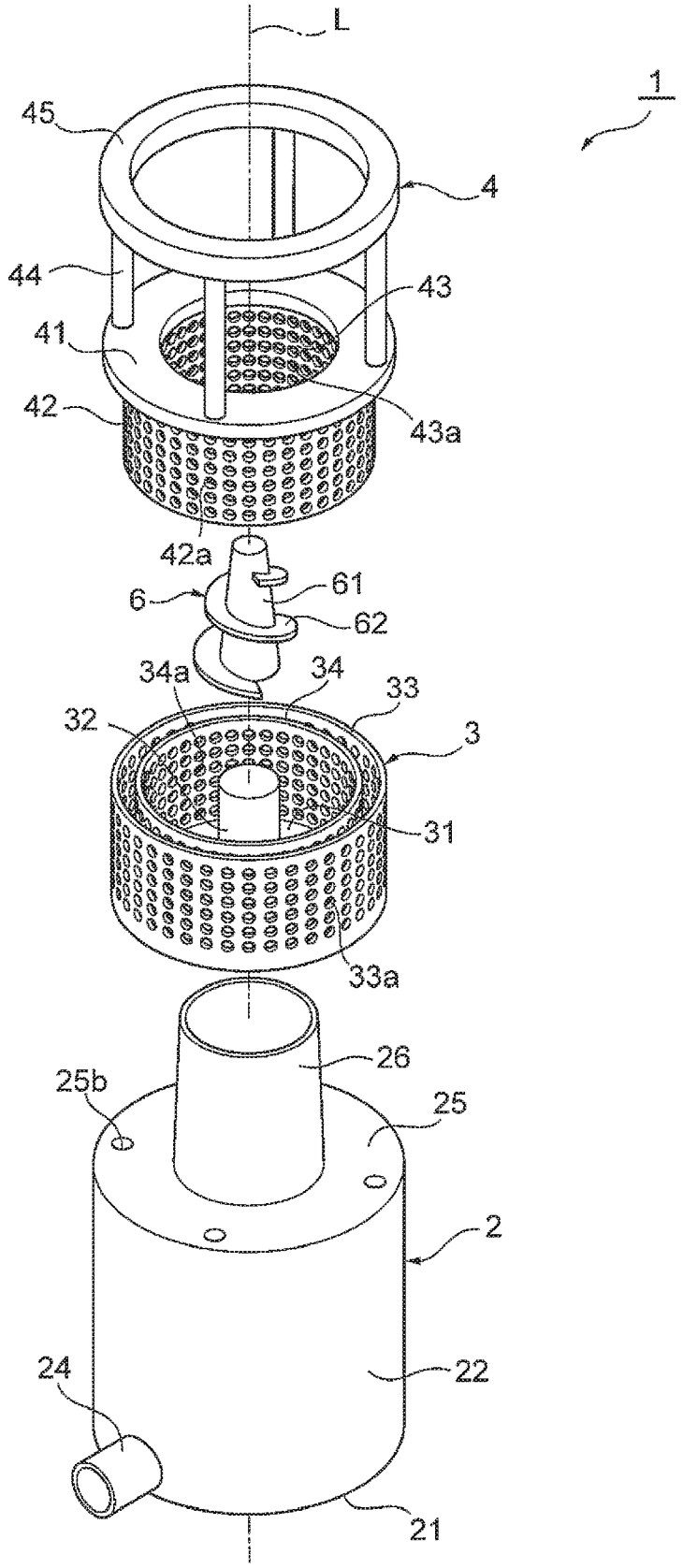
FIG. 1 is an exploded perspective view illustrating an atomization device according to a first embodiment.

In the following, embodiments of an atomization device according to the present invention will be described with reference to the drawings. In the description of the drawings, similar elements are designated with similar signs and any redundant description is omitted. Also in the following description, unless otherwise noted, an "axial line" refers to the axial line of the rotating shaft of a rotor, "inside" refers to radially inside, and "outside" refers to radially outside. Further, in the drawings, to assist in understanding the invention, the distances, intervals and the like between constituent parts may be drawn larger or smaller than they actually are.

First Embodiment

Figure 2:
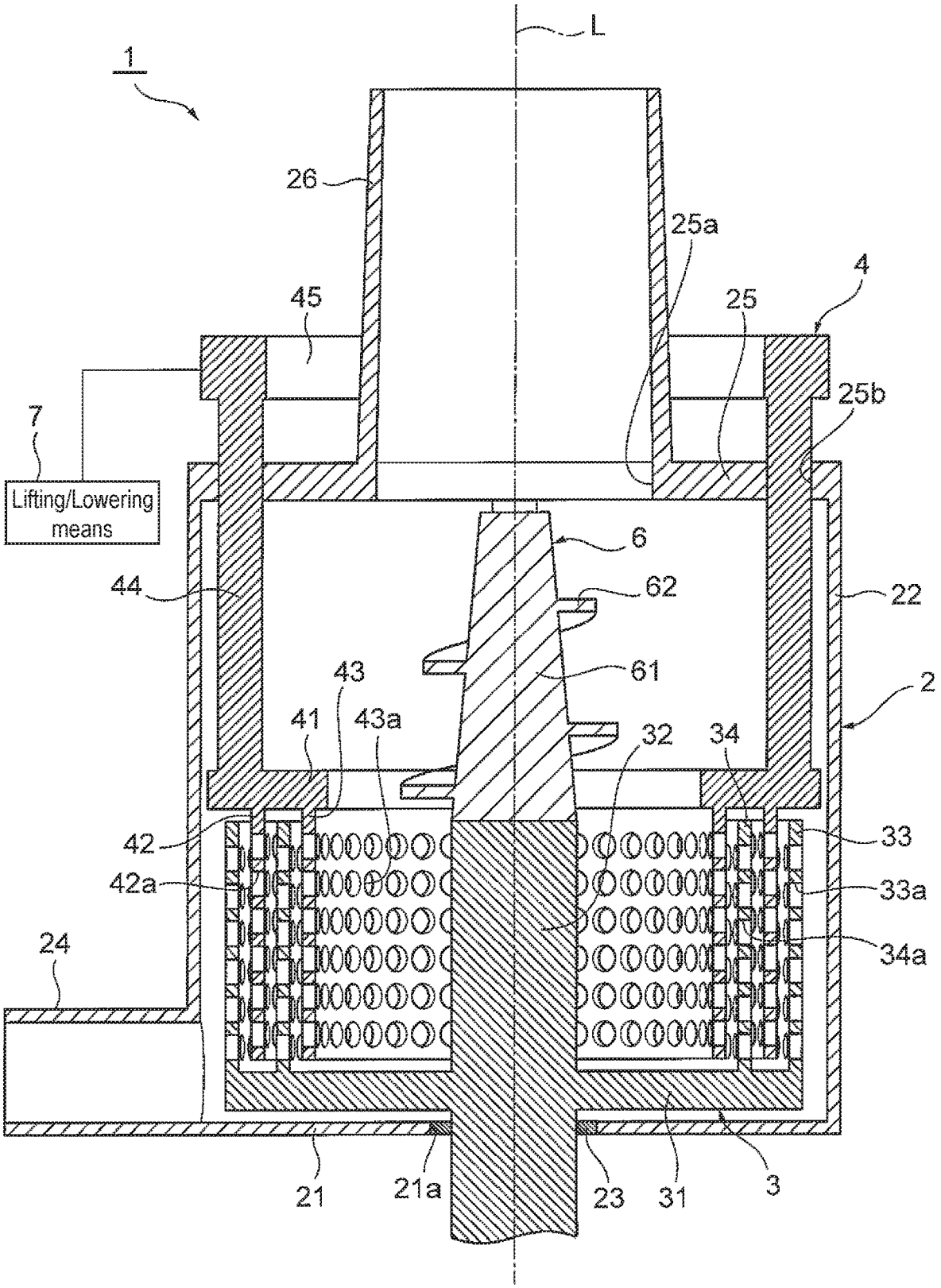
FIG. 2 is a cross-sectional view of the atomization device according to the first embodiment in high shearing mode.
Figure 3:
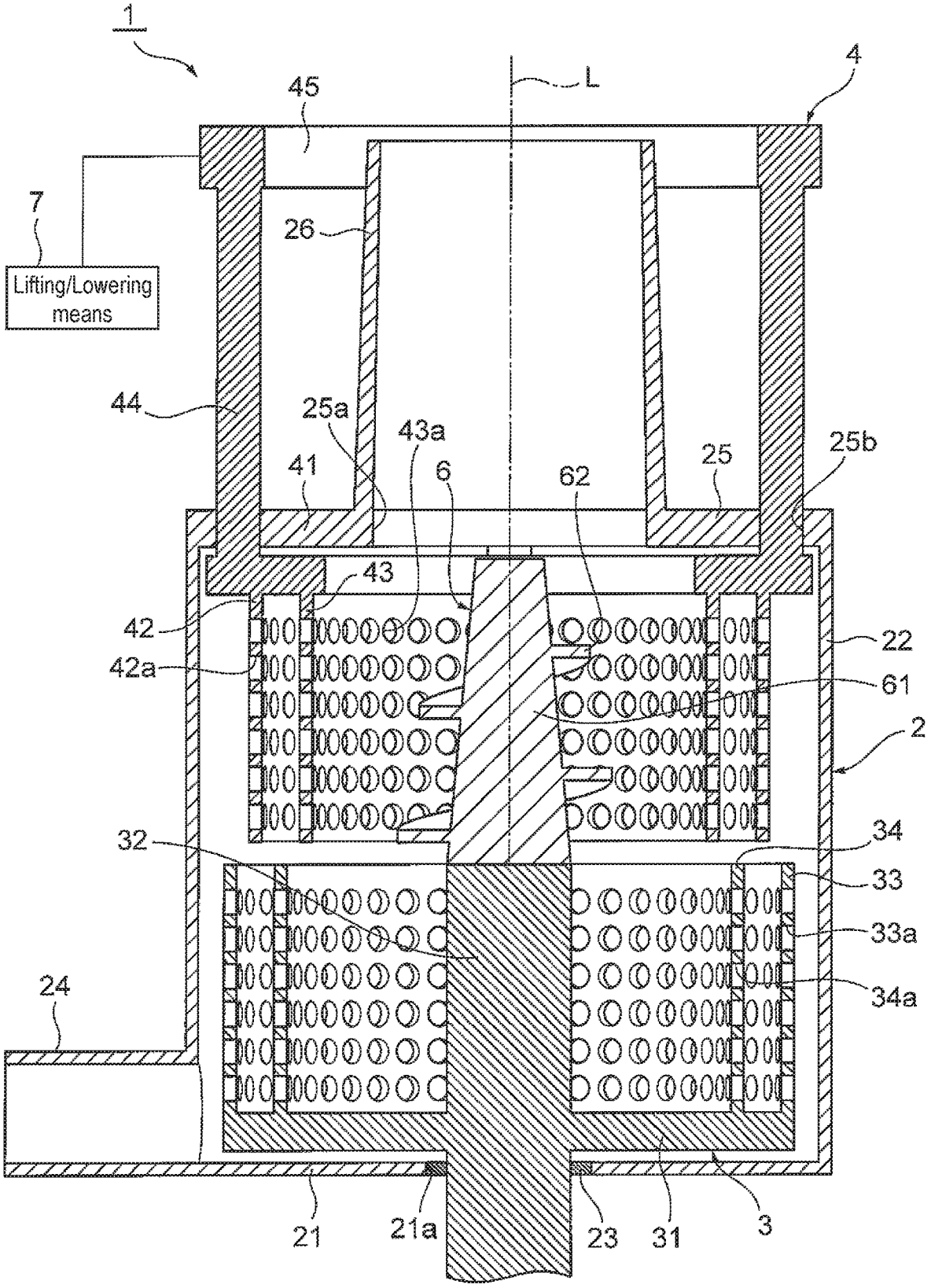
FIG. 3 is a cross-sectional view of the atomization device according to the first embodiment in low shearing mode.

FIG. 1 is an exploded perspective view illustrating an atomization device according to a first embodiment. FIG. 2 is a cross-sectional view of the atomization device according to the first embodiment in high shearing mode. FIG. 3 is a cross-sectional view of the atomization device according to the first embodiment in low shearing mode. The atomization device 1 of the present embodiment is a so-called rotor-stator type in-line atomization device. The device atomizes an object to be atomized by applying shear stress to the object while allowing the object to pass through through-holes provided in a rotor and a stator.

Here, the in-line atomization device is a device that performs an atomization process continuously without circulating the object to be atomized in the device. Accordingly, the effect of reducing atomization variations can be expected. In addition, because the in-line atomization device is a closed system, it is possible to prevent entry of dust, foreign matter and the like from the outside, whereby a contamination prevention effect can also be expected. The object to be atomized means a liquid or a mixture of liquid and powder constituting raw material for foods, chemicals, cosmetics, industrial chemical products and the like. The foods include dairies and beverages. The industrial chemical products include battery materials and the like. Atomization means reducing the particle size of an object through an atomization process. The atomization process may include emulsification, dispersion, stirring, and mixing operations.

The atomization device 1 of the present embodiment is mainly provided with: a casing 2 with an internal accommodating space: a rotor 3 accommodated rotatably in the casing 2: and a stator 4 which is disposed on the same axis line with the rotor 3 and is partly accommodated in the casing 2 and partly exposed out of the casing 2.

The casing 2 is formed from a metal material such as aluminum or stainless steel, and includes: a disc-shaped bottom portion 21: a cylindrical peripheral wall portion 22 rising from the periphery of the bottom portion 21: an annular plate-shaped lid portion 25 opposed to the bottom portion 21; and a loading portion 26 rising from the lid portion 25. In the central position of the bottom portion 21, a shaft hole 21*a* through which a rotating shaft 32 of the rotor 3 (which will be described later) can be passed in airtight state is provided, where the airtight state is maintained by an axial seal 23. In a position of the peripheral wall portion 22 adjacent to the bottom portion 21, a discharge pipe 24 communicating with the inside of the casing 2 is provided to discharge an atomized object to the outside of the casing 2.

In the central position of the lid portion 25, a communication hole 25*a* for providing communication between the loading portion 26 and the inside of the casing 2 is formed. The communication hole 25*a* has a diameter greater than an outer diameter of the rotating shaft 32 of the rotor 3. Around the communication hole 25*a*, four passing holes 25*b* for passing support columns 44 of the stator 4 (which will be described later) therethrough are provided. The passing holes 25*b* are disposed at equal intervals around the communication hole 25*a* so as to surround the communication hole 25*a*.

The loading portion 26 has a substantially circular truncated-conical tubular shape, extends upward from the lid portion 25, and is disposed coaxially with an axial line L of the rotating shaft 32. The upper end of the loading portion 26 is opened outward, and the lower end thereof communicates with the inside of the casing 2 through the aforementioned communication hole 25*a*.

The rotor 3 is formed from a metal material, such as aluminum or stainless steel, and is provided rotatably with respect to the casing 2. The rotor 3 includes: a circular bottom plate portion 31; a rotating shaft 32 provided through the central position of the bottom plate portion 31; and two rotor cylinder portions (a first rotor cylinder portion 33 and a second rotor cylinder portion 34) rising from the bottom plate portion 31. The rotating shaft 32 is disposed with the axial line L thereof aligned with the central axis of the casing 2. A lower end portion of the rotating shaft 32 is passed through the shaft hole 21*a* of the bottom portion 21 and exposed to the outside, and is linked with a motor, which is not illustrated. Thus, the rotating shaft 32 is rotationally driven by the motor.

The first rotor cylinder portion 33 and the second rotor cylinder portion 34 are concentrically disposed about the axial line L of the rotating shaft 32 at predetermined distances, in the order of first and second from the outside toward the inside radially. The first rotor cylinder portion 33 and the second rotor cylinder portion 34 have the same height with respect to the bottom plate portion 31.

A peripheral wall of the first rotor cylinder portion 33 is provided with a plurality of through-holes 33*a* penetrating through the peripheral wall. The through-holes 33*a* are arrayed in a predetermined pattern throughout the entire area of the peripheral wall of the first rotor cylinder portion 33. Similarly, a peripheral wall of the second rotor cylinder portion 34 is provided with a plurality of through-holes 34*a* penetrating through the peripheral wall. The plurality of through-holes 34*a* correspond to the through-holes 33*a* provided in the first rotor cylinder portion 33, and are formed so as to have the corresponding array pattern and positions.

On the other hand, the stator 4 is disposed on the same axis line with the rotor 3, and includes: an annular intermediate plate portion 41 disposed in a substantially intermediate position: two stator cylinder portions (a main-stator cylinder portion 42 and an inside sub-stator cylinder portion 43) descending from the intermediate plate portion 41: four support columns 44 disposed on the opposite side to the stator cylinder portion across the intermediate plate portion 41 and extending upward; and a ring-shaped link portion 45 supported on the support columns 44 and linked with a lifting/lowering means 7 (which will be described later).

The main-stator cylinder portion 42 is disposed so as to be insertable between the first rotor cylinder portion 33 and the second rotor cylinder portion 34 that have been mentioned above. A peripheral wall of the main-stator cylinder portion 42 is provided with a plurality of through-holes 42*a* penetrating through the peripheral wall. The plurality of through-holes 42*a* correspond to the through-holes 33*a* provided in the first rotor cylinder portion 33 and to the through-holes 34*a* provided in the second rotor cylinder portion 34, and may be formed so as to have the corresponding array pattern or a different array pattern.

The inside sub-stator cylinder portion 43 is disposed concentrically with the main-stator cylinder portion 42, and is formed so as to be able to be disposed inside the second rotor cylinder portion 34 of the rotor 3. A peripheral wall of the inside sub-stator cylinder portion 43 is provided with a plurality of through-holes 43*a* penetrating through the peripheral wall. The plurality of through-holes 43*a* correspond to the through-holes 42*a* provided in the main-stator cylinder portion 42, and are formed so as to have the corresponding array pattern and the corresponding positions.

Preferably, in the present embodiment, the through-holes 33*a* provided in the first rotor cylinder portion 33, the through-holes 34*a* provided in the second rotor cylinder portion 34, the through-holes 42*a* provided in the main-stator cylinder portion 42, and the through-holes 43*a* provided in the inside sub-stator cylinder portion 43 are circular. When the circular through-holes are adopted, compared to when through-holes of other shapes such as rectangular or U-shape are adopted, it is possible to ensure a long wetted perimeter while improving the through-hole processing efficiency.

The through-holes 33*a* in the first rotor cylinder portion 33, the through-holes 34*a* in the second rotor cylinder portion 34, the through-holes 42*a* in the main-stator cylinder portion 42, and the through-holes 43*a* in the inside sub-stator cylinder portion 43 may have the same hole size or may have respectively different hole sizes. When the hole sizes are different, it is preferable to form the through-holes such that the hole size becomes greater from the inside to the outside. In this way, atomization performance can be enhanced, making it possible to make the particle size of the object smaller.

Meanwhile, the support columns 44 has a columnar shape, and is slidably passed through the passing holes 25*b* in the lid portion 25. The link portion 45 is linked with the lifting/lowering means 7, and can be moved up and down by the lifting/lowering means 7. For the lifting/lowering means 7, it is possible to use a known means, such as a hydraulic cylinder, an air cylinder, an actuator, or a ball screw. The link portion 45 and the lifting/lowering means 7 may be linked using any well-known technique.

The stator 4 thus configured is assembled with the casing 2 in a state in which the intermediate plate portion 41, the main-stator cylinder portion 42, and the inside sub-stator cylinder portion 43 are accommodated in the casing 2 while the link portion 45 is exposed to the outside of the casing 2 and the support columns 44 are slidably passed through the passing holes 25*b* in the lid portion 25. The stator 4 is movable by the lifting/lowering means 7 in the axial line L direction (i.e., in the up-down directions).

The atomization device 1 of the present embodiment is further provided with an impeller 6 for forcibly pushing the object into the casing 2. The impeller 6 is disposed on the same axis line with the rotating shaft 32, is secured to the upper end of the rotating shaft 32 adhesively or by screwing, for example, and is rotated as the rotating shaft 32 rotates. Preferably, the impeller 6 is secured to the upper end of the rotating shaft 32 by screwing. In this way, the impeller 6 can be detached easily, making it possible to easily perform operations for repairing or replacing the impeller 6, for example. The impeller 6 includes a circular truncated conical body 61 decreasing in diameter toward the top, and a spiral screw vane 62 formed on an outer peripheral surface of the body 61. The impeller 6, which is formed from a metal material such as aluminum or stainless steel, is disposed directly under the loading portion 26 and pushes the object loaded via the loading portion 26 into the casing 2.

As noted above, the stator 4 is movable by the lifting/lowering means 7 in the axial line L direction. Accordingly, the stator 4 can be lifted and lowered between a lower-most position illustrated in FIG. 2 and an upper-most position illustrated in FIG. 3, and can be stopped at an arbitrary position. Thus, the atomization device 1 of the present embodiment has a mode with the maximum shear stress (a high shearing mode illustrated in FIG. 2) and a mode with the minimum shear stress mode (a low shearing mode illustrated in FIG. 3), and can freely adjust the shear stress between these modes, as will be described in detail below.

In the high shearing mode illustrated in FIG. 2, the stator 4 is in the lower-most position with respect to the casing 2. At this time, the main-stator cylinder portion 42 is inserted between the first rotor cylinder portion 33 and the second rotor cylinder portion 34, and the inside sub-stator cylinder portion 43 is disposed inside the second rotor cylinder portion 34. These cylinder portions are disposed concentrically in the order of the inside sub-stator cylinder portion 43, the second rotor cylinder portion 34, the main-stator cylinder portion 42, and the first rotor cylinder portion 33 from the inside to the outside.

Accordingly, in the atomization device 1 of the present embodiment, a four-stage atomization mechanism is formed. That is, the structure is such that shear stress is applied to the object loaded into the device as the object is caused to pass through the through-holes 43*a* in the inside sub-stator cylinder portion 43 (the first stage), the through-holes 34*a* in the second rotor cylinder portion 34 (the second stage), the through-holes 42*a* in the main-stator cylinder portion 42 (the third stage), and the through-holes 33*a* in the first rotor cylinder portion 33 (the fourth stage) successively.

Thus, the object loaded into the casing 2 is atomized to a predetermined size by being subjected to high shear stress produced by high-speed rotation of the rotor 3 as the object passes, due to the centrifugal force generated by the high-speed rotation of the rotor 3, through the through-holes 43*a* in the inside sub-stator cylinder portion 43, the through-holes 34*a* in the second rotor cylinder portion 34, the through-holes 42*a* in the main-stator cylinder portion 42, and the through-holes 33*a* in the first rotor cylinder portion 33 successively.

On the other hand, when the stator 4 is lifted by the lifting/lowering means 7, the relative positions of the main-stator cylinder portion 42 and the inside sub-stator cylinder portion 43 to the first rotor cylinder portion 33 and the second rotor cylinder portion 34 are changed. Accordingly, the positions of the through-holes 42*a* in the main-stator cylinder portion 42 and the through-holes 43*a* in the inside sub-stator cylinder portion 43 relative to the through-holes 33*a* in the first rotor cylinder portion 33 and the through-holes 34*a* in the second rotor cylinder portion 34 are also changed.

In the low shearing mode illustrated in FIG. 3, the stator 4 is in the upper-most position with respect to the casing 2. At this time, the lower ends of the main-stator cylinder portion 42 and the inside sub-stator cylinder portion 43 are positioned above the upper ends of the first rotor cylinder portion 33 and the second rotor cylinder portion 34. Thus, a two-stage atomization mechanism is formed of the second rotor cylinder portion 34 having the through-holes 34*a* (the first stage) and the first rotor cylinder portion 33 having the through-holes 33*a* (the second stage).

In the atomization device 1 of the present embodiment, the stator 4 is configured to be movable in the axial line L direction. Accordingly, by changing the position of the main-stator cylinder portion 42 and the inside sub-stator cylinder portion 43 relative to the first rotor cylinder portion 33 and the second rotor cylinder portion 34, it is possible to freely adjust the shear stress applied to the object between high shearing mode and low shearing mode. As a result, it is possible to improve atomization performance and versatility of the device. In addition, in the case of low shearing mode, because the stator 4 is in the upper-most position, the rotor 3 can be caused to function as a pump and a stirrer. Thus, bubbling can be suppressed during dissolution, making it possible to obtain a good dissolved state of the object. In particular, when the object is a powder, dissolution involves vigorous bubbling. Accordingly, by utilizing low shearing mode, it is possible to suppress the bubbling and to ensure a good dissolved state.

In addition, it is possible to form a multiple-stage atomization mechanism based on a combination of the first rotor cylinder portion 33 and the second rotor cylinder portion 34 of the rotor 3 and the main-stator cylinder portion 42 and the inside sub-stator cylinder portion 43 of the stator 4. Accordingly, the device volume inside the casing 2 can be effectively utilized, making it possible to improve the volume efficiency of the atomization device 1, to achieve a scale-up, and to make performance adjustments.

Further, the impeller 6 is provided to forcibly push the object, so that it is possible to load the object into the casing 2 uniformly and smoothly. In addition, because the object is loaded in a state of being pressurized by the impeller 6, generation of cavitation in the device can be suppressed, providing the effect of further increasing the atomization performance.

The present embodiment has been described with reference to the example in which the rotor 3 has two rotor cylinder portions (i.e., the first rotor cylinder portion 33 and the second rotor cylinder portion 34), and the stator 4 has two stator cylinder portions (i.e., the main-stator cylinder portion 42 and the inside sub-stator cylinder portion 43). However, the numbers of the rotor cylinder portion and the stator cylinder portions may be increased or decreased, as needed or as appropriate. Further, in the present embodiment, while the example has been described in which the lifting/lowering means 7 is used, the lifting/lowering of the stator 4 may be performed manually by an operator, instead of by the lifting/lowering means 7. Furthermore, a plurality of depressions may be provided throughout the entire area of the inner wall surface of the peripheral wall portion 22 of the casing 2. By thus providing depressions, turbulence is generated more readily, providing the effect of enhancing the atomization performance.

Second Embodiment

Figure 4:
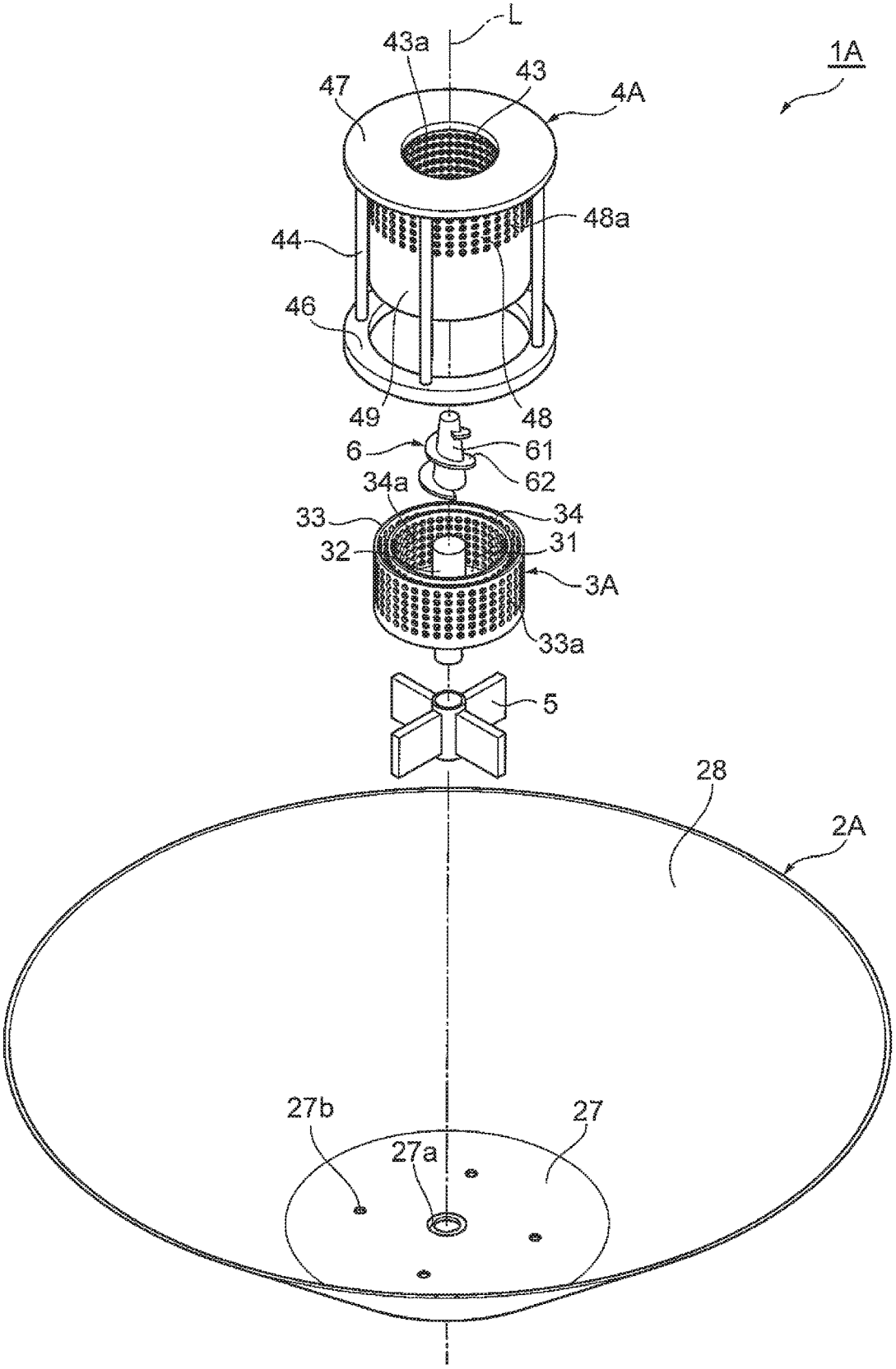
FIG. 4 is an exploded perspective view illustrating an atomization device according to a second embodiment.
Figure 5:
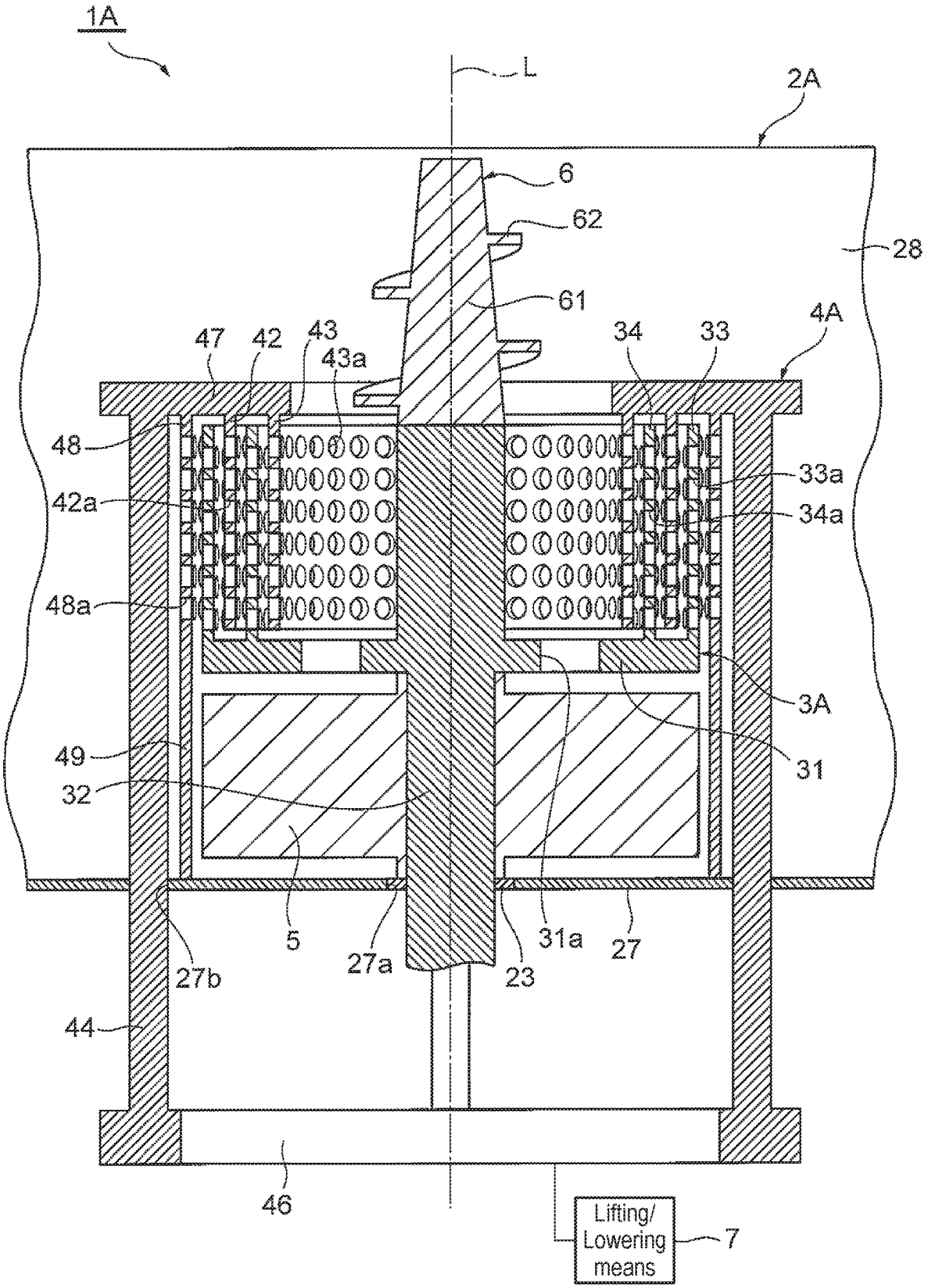
FIG. 5 is a partial cross-sectional view of the atomization device according to the second embodiment in high shearing mode.
Figure 6:
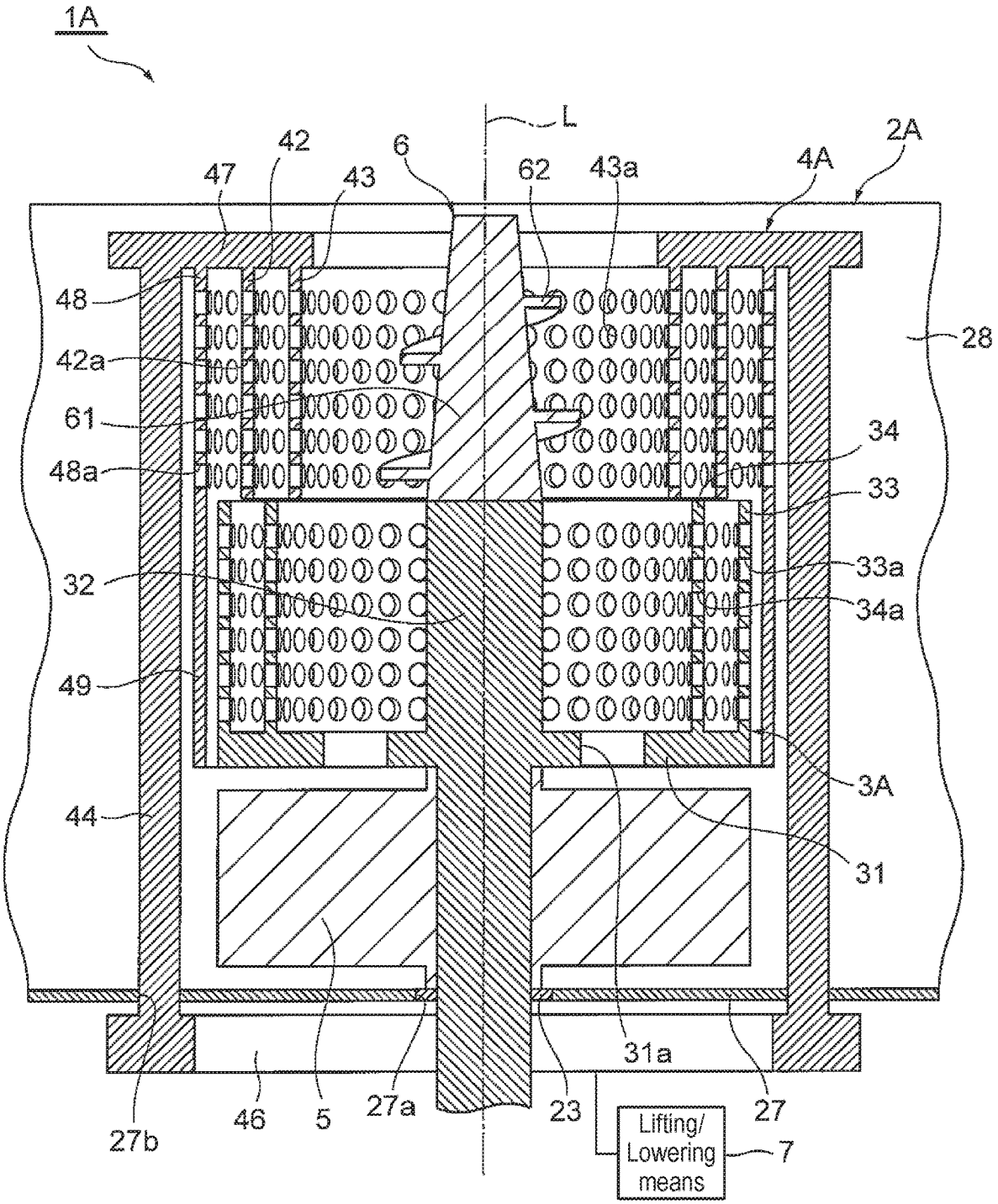
FIG. 6 is a partial cross-sectional view of the atomization device according to the second embodiment in low shearing mode.

FIG. 4 is an exploded perspective view illustrating an atomization device according to a second embodiment. FIG. 5 is a partial cross-sectional view of the atomization device according to the second embodiment in high shearing mode. FIG. 6 is a partial cross-sectional view of the atomization device according to the second embodiment in low shearing mode. The atomization device 1A of the present embodiment differs from the first embodiment described above in being a batch-type atomization device that performs atomization while circulating the object in the device.

Specifically, the atomization device 1A of the present embodiment is provided with: a tank 2A with an outer opening; a rotor 3A of which the position is fixed with respect to a bottom portion 27 of the tank 2A; and a stator 4A disposed on the same axis line with the rotor 3A. The tank 2A, which corresponds to a "casing" recited in the claims, has a bottomed circular truncated conical tubular shape with an upper opening in cross section, and includes the bottom portion 27, which is disc-shaped, and a side wall portion 28 gradually increasing in diameter from the periphery of the bottom portion 27 toward the top.

As illustrated in FIG. 4, in the central position of the bottom portion 27, a shaft hole 27*a* through which the rotating shaft 32 of the rotor 3A can be passed in airtight state is provided, where the airtight state is maintained by the axial seal 23. Around the shaft hole 27*a*, four passing holes 27*b* for passing the support columns 44 of the stator 4A are provided. The passing holes 27*b* are disposed at equal intervals around the shaft hole 27*a* so as to surround the shaft hole 27*a*.

The rotor 3A has substantially the same structure as the rotor 3 of the first embodiment, and includes: a circular bottom plate portion 31; the rotating shaft 32 provided through the central position of the bottom plate portion 31; and two rotor cylinder portions (a first rotor cylinder portion 33 and a second rotor cylinder portion 34) rising from the bottom plate portion 31. An impeller 6 is secured to the upper end of the rotating shaft 32. The bottom plate portion 31 is provided with four through-holes 31*a* right-left and front-rear symmetrically with respect to the axial line L of the rotating shaft 32.

The rotor 3A is secured to the tank 2A with a space provided between the bottom plate portion 31 of the rotor 3A and the bottom portion 27 of the tank 2A. In the space between the bottom plate portion 31 and the bottom portion 27 of the tank 2A, a rotary blade 5 is provided. The rotary blade 5 has four vanes disposed at equal intervals circumferentially, and is inserted onto the rotating shaft 32 so as to rotate as the rotating shaft 32 rotates.

On the other hand, the stator 4A includes: an annular pedestal portion 46 and a top plate portion 47 which are opposed to each other; and four support columns 44 which are disposed between the pedestal portion 46 and the top plate portion 47 so as to link the pedestal portion 46 and the top plate portion 47. The support columns 44 are columnar and are slidably passed through the passing holes 27*b* in the bottom portion 27 of the tank 2A.

The top plate portion 47 have three stator cylinder portions (a main-stator cylinder portion 42, an inside sub-stator cylinder portion 43, and an outside sub-stator cylinder portion 48) descending therefrom. The main-stator cylinder portion 42, the inside sub-stator cylinder portion 43, and the outside sub-stator cylinder portion 48 are disposed concentrically about the axial line L and at predetermined distances, and are disposed in the order of, from the inside to the outside radially, the inside sub-stator cylinder portion 43, the main-stator cylinder portion 42, and the outside sub-stator cylinder portion 48.

The main-stator cylinder portion 42 is disposed so as to be insertable between the first rotor cylinder portion 33 and the second rotor cylinder portion 34 that have been mentioned above. A peripheral wall of the main-stator cylinder portion 42 is provided with a plurality of through-holes 42*a* penetrating through the peripheral wall.

The inside sub-stator cylinder portion 43 is formed so as to be able to be disposed inside the second rotor cylinder portion 34, and has a peripheral wall provided with a plurality of through-holes 43*a* penetrating through the peripheral wall. The plurality of through-holes 43*a* correspond to the through-holes 42*a* provided in the main-stator cylinder portion 42, and are formed so as to have the corresponding array pattern and the corresponding positions.

The outside sub-stator cylinder portion 48 are formed so as to be able to be disposed outside the first rotor cylinder portion 33, and has a peripheral wall provided with a plurality of through-holes 48*a* penetrating through the peripheral wall. The plurality of through-holes 48*a* correspond to the through-holes 42*a* provided in the main-stator cylinder portion 42, and are formed so as to have the corresponding array pattern and the corresponding positions.

Under the outside sub-stator cylinder portion 48, a cylindrical skirt portion 49 formed integrally with the outside sub-stator cylinder portion 48 is provided. The skirt portion 49, as opposed to the outside sub-stator cylinder portion 48, does not have through-holes formed therein.

The stator 4A thus configured is assembled with the tank 2A in a state in which: the pedestal portion 46 is disposed under the bottom portion 27 of the tank 2A; the top plate portion 47, the inside sub-stator cylinder portion 43, the main-stator cylinder portion 42, the outside sub-stator cylinder portion 48, and the skirt portion 49 are disposed in the tank 2A: and the support columns 44 are slidably passed through the passing holes 27*b* in the tank 2A. The stator 4A is movable along the axial line L direction (i.e., the up-down directions) by a lifting/lowering means 7 disposed under the pedestal portion 46.

The stator 4A, being movable in the axial line L direction by the lifting/lowering means 7, can be lifted and lowered between the lower-most position illustrated in FIG. 5 and the upper-most position illustrated in FIG. 6 and can be stopped at an arbitrary position. Accordingly, the atomization device 1A of the present embodiment has the maximum shear stress mode (high shearing mode illustrated in FIG. 5) and the minimum shear stress mode (low shearing mode illustrated in FIG. 6), and can freely adjust the shear stress between these modes, as will be described in detail below.

In the high shearing mode illustrated in FIG. 5, the stator 4A is in the lower-most position. At this time, the main-stator cylinder portion 42 is inserted between the first rotor cylinder portion 33 and the second rotor cylinder portion 34, the inside sub-stator cylinder portion 43 is inside the second rotor cylinder portion 34, and the outside sub-stator cylinder portion 48 is disposed outside the first rotor cylinder portion 33. The cylinder portions are disposed concentrically in the order of, from the inside to the outside: the inside sub-stator cylinder portion 43: the second rotor cylinder portion 34: the main-stator cylinder portion 42; the first rotor cylinder portion 33: and the outside sub-stator cylinder portion 48.

Thus, in the atomization device 1A of the present embodiment, a five-stage atomization mechanism is formed. That is, the structure is such that shear stress is applied to the object loaded into the device as the object is caused to pass through: the through-holes 43*a* in the inside sub-stator cylinder portion 43 (the first stage); the through-holes 34*a* in the second rotor cylinder portion 34 (the second stage); the through-holes 42*a* in the main-stator cylinder portion 42 (the third stage): the through-holes 33*a* in the first rotor cylinder portion 33 (the fourth stage); and the through-holes 48*a* in the outside sub-stator cylinder portion 48 (fifth stage) successively.

In this case, some of the object pushed into the device by the impeller 6 drops, through the through-holes 31*a* in the bottom plate portion 31, into the space formed by the bottom plate portion 31 and the bottom portion 27 of the tank 2A, and the skirt portion 49, where the object is stirred by the rotary blade 5. The object that has dropped is prevented by the skirt portion 49 from being discharged into the tank 2A In the low shearing mode illustrated in FIG. 6, the stator 4A is in the upper-most position. At this time, the lower ends of the main-stator cylinder portion 42, the inside sub-stator cylinder portion 43, and the outside sub-stator cylinder portion 48 are positioned above the upper ends of the first rotor cylinder portion 33 and the second rotor cylinder portion 34. Thus, a two-stage atomization mechanism is formed by the second rotor cylinder portion 34 having the through-holes 34*a* (the first stage) and the first rotor cylinder portion 33 having the through-holes 33*a* (the second stage).

According to the atomization device 1A of the present embodiment, operational effects similar to those of the aforementioned first embodiment can be obtained. While the present embodiment has been described with reference to the example in which the rotary blade 5 and the skirt portion 49 are provided, the rotary blade 5 and the skirt portion 49 may not be provided. The numbers of the rotor cylinder portion and the stator cylinder portions may be increased or decreased, as needed as appropriate. Further, while the present embodiment has been described with reference to the example in which the stator 4A is movable in the axial line L direction by the lifting/lowering means 7, the rotor 3A may be movable in the axial line L direction by the lifting/lowering means 7, instead of the lifting/lowering of the stator 4A. For example, referring to FIG. 5, the lifting/lowering means 7 is installed under the bottom portion 27 of the tank 2A, and the rotor 3A is lifted and lowered, together with the tank 2A, along the axial line L direction by utilizing the lifting/lowering means 7. In this case, similar operational effects can be obtained.

In the following, the present invention is described with reference to an implementation example. However, the present invention is not limited to the scope of the implementation example.

Implementation Example

In the present implementation example, the relationship between elapsed time and particle size was investigated using the atomization device 1 (inventive products) of the first embodiment. The object used, which was identical in all of the inventive products and a conventional product of a comparative example indicated below, was the "Meiji Hohoemi" (registered trademark) milk formula manufactured by Meiji Co., Ltd. Herein, the particle size refers to the central value (also referred to as median or d50) of particle size.

Comparative Example

For comparison, the TK Homomixer MKII Model 2.5 (conventional product) from PRIMIX Corporation was used as a conventional emulsification device, and the relationship between elapsed time and particle size was investigated under the same conditions as in the implementation example.

Figure 7:
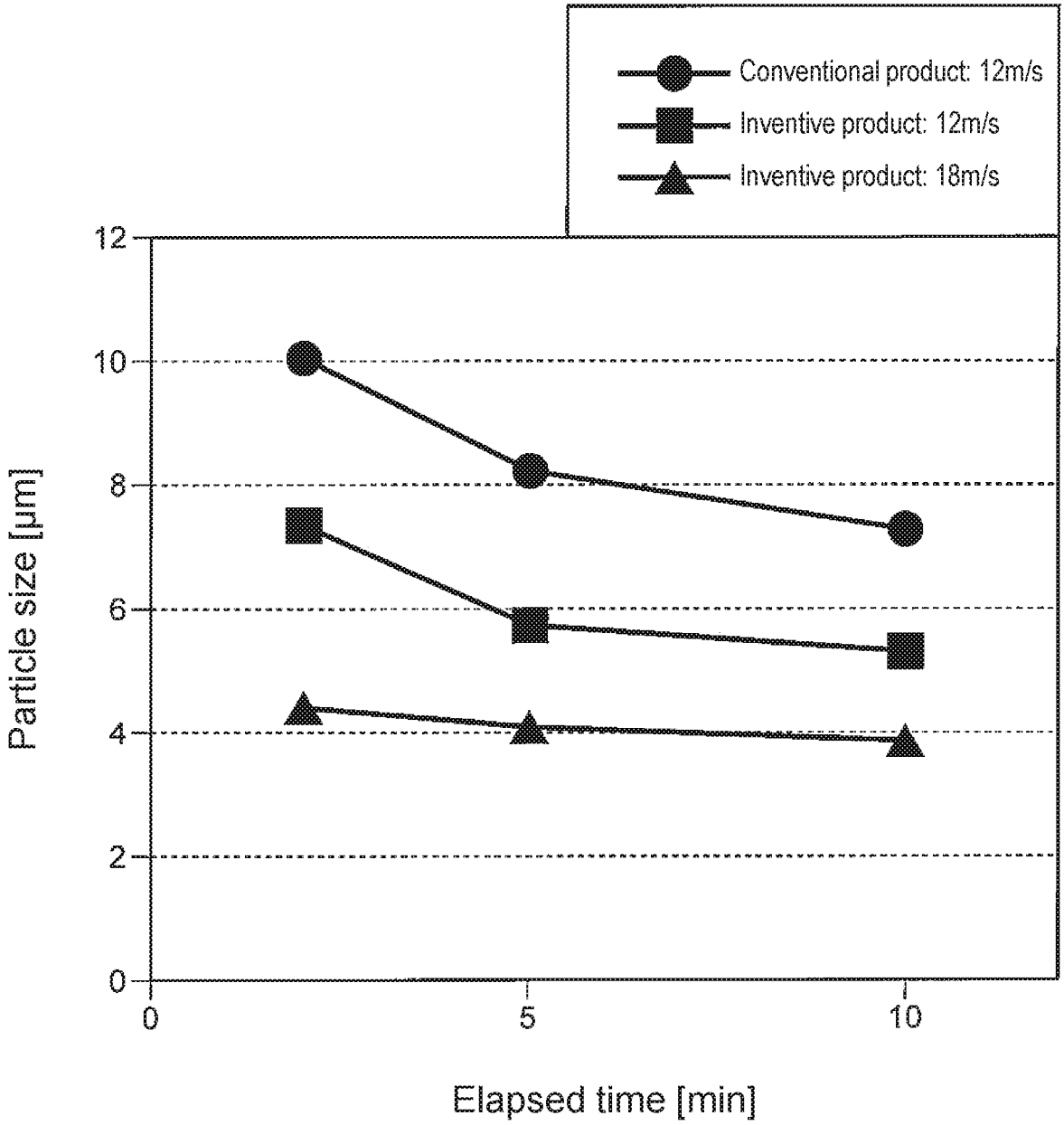
FIG. 7 illustrates the results of comparison of inventive products and a conventional product with respect to the relationship between elapsed time and particle size.

FIG. 7 illustrates the results of comparison between the inventive products and the conventional product with respect to the relationship between elapsed time and particle size. As will be seen from FIG. 7, a particle size reached in 10 minutes at a peripheral speed of 12 meters per seconds (m/s) by the conventional product was achieved in 2 minutes by an inventive product (peripheral speed 12 m/s). By further increasing the peripheral speed of the inventive product (12 m/s→18 m/s), it was possible to obtain particle sizes that the conventional product was impossible to reach. Thus, it was proven that the inventive products provided higher atomization capability (i.e., performance) compared to the conventional product.

While the embodiments of the present invention have been described in detail, the present invention is not limited to the aforementioned embodiments and various design modifications may be made without departing from the scope and spirit of the present invention set forth in the claims. For example, the array pattern of the through-holes in the rotor cylinder portion and the stator cylinder portion is not limited to that of the aforementioned embodiments and may be a staggered pattern, for example.

REFERENCE SIGNS LIST

1, 1A Atomization device
2 Casing
2A Tank (casing)

3, 3A Rotor
4, 4A Stator
5 Rotary blade
6 Impeller
7 Lifting/lowering means
21, 27 Bottom portion
21*a*. 27*a* Shaft hole
22 Peripheral wall portion
23 Axial seal
24 Discharge pipe
25 Lid portion
25*a* Communication hole
25*b*, 27*b* Passing hole
26 Loading portion
28 Side wall portion
31 Bottom plate portion
32 Rotating shaft
33 First rotor cylinder portion
34 Second rotor cylinder portion
33*a*, 34*a*, 42*a*, 43*a*, 48*a* Through-hole
41 Intermediate plate portion
42 Main-stator cylinder portion
43 Inside sub-stator cylinder portion
44 Support column
45 Link portion
46 Pedestal portion
47 Top plate portion
48 Outside sub-stator cylinder portion
49 Skirt portion
61 Body
62 Screw vane
L Axial line

The invention claimed is:

1. An atomization device comprising:

a casing;

a rotor disposed rotatably with respect to the casing; and a stator disposed on the same axis line with the rotor, wherein:

the rotor has a plurality of concentrically disposed rotor cylinder portions each having a plurality of through-holes provided in a peripheral wall thereof;

the stator has at least one main-stator cylinder portion which has a plurality of through-holes provided in a peripheral wall thereof and which is inserted between rotor cylinder portions adjacent to each other; and the rotor and the stator are relatively movable along the axial line direction, wherein the rotor is fixedly positioned with respect to the casing, and the stator is movable by a lifting/lowering means along the axial line direction.

2. The atomization device according to claim 1, wherein the stator further includes an inside sub-stator cylinder portion which is disposed inside a rotor cylinder portion positioned on an inner-most side radially among the plurality of rotor cylinder portions, and which has a plurality of through-holes provided in a peripheral wall thereof.

3. The atomization device according to claim 1, wherein the stator further includes an outside sub-stator cylinder portion which is disposed outside a rotor cylinder portion positioned on an outer-most side radially among the plurality of rotor cylinder portions, and which has a plurality of through-holes provided in a peripheral wall thereof.

4. The atomization device according to claim 1, wherein the stator is movable such that a lower end of the main-stator cylinder portion is positioned above an upper end of the rotor cylinder portions.

5. The atomization device according to claim 1, wherein the stator further includes a link portion formed integrally with the main-stator cylinder portion and linked with the lifting/lowering means.

6. The atomization device according to claim 1, wherein the casing is a tank with an upper opening, the atomization device further including a rotary blade which is disposed between a bottom portion of the casing and the rotor and which rotates as the rotor rotates.

* * * * *